United States Patent [19]

Wells

[11] Patent Number: 4,673,099

[45] Date of Patent: Jun. 16, 1987

[54] RECLOSABLE SELF-OPENING CAN END

[76] Inventor: Robert A. Wells, Box 995723, Steamboat Village, Colo. 80499

[21] Appl. No.: 410,422

[22] Filed: Aug. 23, 1982

[51] Int. Cl.[4] ..... B65D 41/32

[52] U.S. Cl. ..... 220/269; 220/258; 220/273

[58] Field of Search ..... 220/273, 269, 258, 260, 220/270, 359, 307, 261

[56] References Cited

U.S. PATENT DOCUMENTS

| | | | |
|---|---|---|---|
| 2,991,000 | 7/1961 | Spees | 229/51 |
| 3,182,728 | 5/1965 | Zabriskie | 169/32 |
| 3,186,628 | 6/1965 | Rohde | 229/66 |
| 3,189,174 | 6/1965 | Cormack | 206/63.2 |
| 3,298,597 | 1/1967 | Bellamy, Jr. | 229/55 |
| 3,608,709 | 9/1971 | Pike | 206/47 |
| 3,627,611 | 12/1971 | Bonk | 156/306 |
| 3,756,389 | 9/1973 | Firth | 206/47 |
| 3,874,504 | 4/1975 | Verakas | 206/219 |
| 3,950,158 | 4/1976 | Gossett | 62/4 |
| 3,983,994 | 10/1976 | Wyslotsky | 206/219 |
| 4,000,996 | 1/1977 | Jordan | 62/4 |
| 4,189,060 | 2/1980 | Trotman, III | 220/269 |
| 4,210,257 | 7/1980 | Radtke | 220/273 |
| 4,226,330 | 10/1980 | Butler | 206/620 |
| 4,227,614 | 10/1980 | Hollander, Jr. | 206/459 |
| 4,232,797 | 11/1980 | Waterbury | 220/269 |
| 4,276,263 | 6/1981 | Andersen et al. | 422/292 |
| 4,391,385 | 7/1983 | Rausing | 220/269 |
| 4,433,792 | 2/1984 | Mandel | 220/269 |
| 4,442,950 | 4/1984 | Wilson | 220/269 |
| 4,463,866 | 8/1984 | Mandel | 220/258 |

*Primary Examiner*—Joseph Man-Fu Moy
*Attorney, Agent, or Firm*—Jones & Askew

[57] ABSTRACT

An easy-open beverage container which can be selectably reclosed and reopened, after the container initially is opened. The reclosure structure may be contained on an opening tab, or alternatively may be separate from the tab.

15 Claims, 47 Drawing Figures

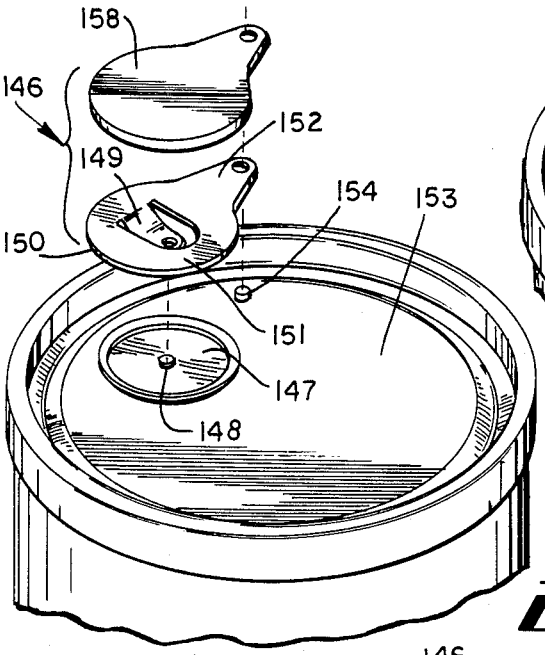
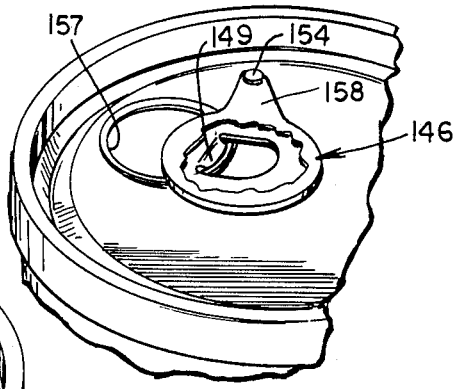
Fig. 16B
Fig. 16A
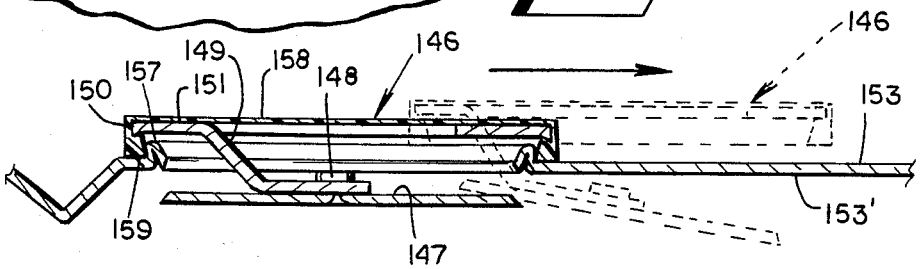
Fig. 16C
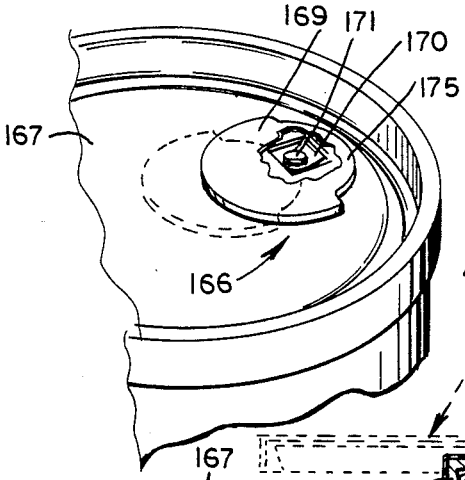
Fig. 17A
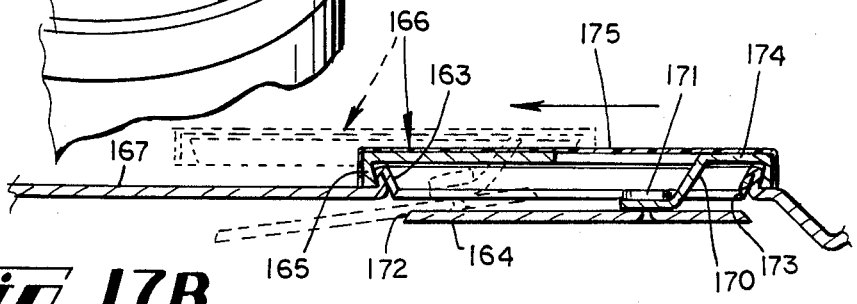
Fig. 17B

RECLOSABLE SELF-OPENING CAN END

FIELD OF INVENTION

This invention relates in general to cotnainers such as beverage cans or the like, and relates in particular to self-opening beverage cans capable of being selectably reclosed once the can is opened.

BACKGROUND OF THE INVENTION

Easy-open containers have found widespread acceptance and extensive use in various applications. Perhaps the best-known such application is in the field of beverage containers, where individual cans of beverages such as beer or soft drinks are equipped with an end wall having a manually-openable structure.

In recent years, easy-open ends intended for beverage containers have included nondetachable tabs or related elements which remained with the can after opening, for ecological reasons. Although various easy-open can ends have become known to the art, these ends generally have in common the traditional function of selectably providing a relatively small opening in the end wall of a can or other container, so that the contents of the container can be drunk or otherwise dispensed through the opening. This opening typically is formed in the can and by tearing away or otherwise detaching a removable panel from the end wall. Once this panel is detached, the container is opened and cannot be closed thereafter to protect or preserve its contents. While this presents no problem if the entire contents of the container are consumed immediately after opening, many persons find their appetites satisfied after drinking only part of a newly-opened beverage, or for some other reason desire to set aside the beverage for later consumption or use.

A partially-empty beverage container needs to be reclosed in some fashion when saving the contents for later. Reclosing the container prevents or at least retards spoilage, and prevents contamination from foreign objects entering the opened container. Even where the opened container is stored in a refrigerator or other enclosure, reclosing the container helps prevent a stale taste due to commingling of odors with other foods in the refrigerator, or due to decomposition from exposure with air. Moreover, an airtight reclosure helps maintain carbonation of carbonated beverages such as soft drinks or beer.

While container reclosure may be relatively straightforward with bottles using screw-on caps, reclosing the typical beverage can is another matter. The tear-out panel associated with the typical easy-open can generally is deformed and/or positioned within the can below the end wall during the opening procedure, and thus is unavailable to reclose the opening in that wall. Prior-art expedients to overcome this problem generally have utilized separate stoppers, purchased as accessories, intended to fit on the end of an opened can and temporarily plug the opening. These separate stoppers are relatively small and easily misplaced or simply forgotten, and thus are usually unavailable to someone wanting to reclose an open beverage container. Furthermore, the structural variations between easy-open ends supplied by different manufacturers makes it difficult to provide an accessory stopper which effectively works with the variety of beverage cans commonly available to consumers.

Prior-art attempts to incorporate a reclosure on the structure of a beverage can generally have not met with acceptance in the can industry. One example of a prior art reclosure is shown in U.S. Pat. No. 3,880,319.

SUMMARY OF THE INVENTION

Stated generally, container end walls equipped according to the present invention have a removable panel defined in the wall at least in part by a selectably separable region on the wall, and have an opening tab or member movably attached to the wall. The opening tab is equipped to initiate release of internal pressure within the can, in the case of a carbonated beverage or othrewise pressurized can, and to separate the panel partially or completely from the container wall. A reclosure member is movable after the panel is opened by the opening tab, either as part of the tab or as a separate element, and this reclosure can be brought into registry with the opening formed in the wall by separation and displacement of the panel. The reclosure removably engages the wall for retention in the opening, thereby reclosing the container and protecting its contents. The reclosure may include a fluid seal to provide or augment a fluid tight reclosure. The reclosure is readily disengaged and displaced from the opening when desired, yet remains attached to the end wall and may again the container.

Accordingly, it is an object of the present invention to provide an improved reclosable easy-opening container.

It is another object of the present invention to provide an easy-opening container with attached reclosure structure enabling the container to be reclosed once opened.

It is still another object of the present invention to provide an easy-open container with a reclosure which is relatively simple and economical to fabricate as part of the container.

Other objects and advantages of the present invention will become more readily apparent from the following description of several preferred emobiments.

BRIEF DESCRIPTION OF DRAWINGS

FIGS. 16A–16C show an alternative embodiment, having the reclosure structure secured above the opening panel and pivotably attached to the container end wall. FIG. 16B is partially broken away to show the reclosure cover on the opening tab.

FIGS. 17A and 17B show still another embodiment, with the reclosure structure forming part of an opening tab secured to the panel and retained on the end wall by the nonremovable opening panel.

DESCRIPTION OF PREFERRED EMBODIMENTS

Turning first to the embodiment shown in FIGS. 1–6, there is shown generally at 25 a beverage container provided with an end wall 26 according to the present invention. An openable panel 27 is defined in the end wall 26 by a selectably separable region 28 of predetermined structural weakness. This separable region 28 typically is a score line stamped into the end wall 26, defining a relatively thin frangible score line which can be fractured to separate the panel 27 from the remainder of the end wall, when desired; details of such selectably separable regions are well-known in the can end art. The separable region 28 is interrupted by an unscored region 29, FIG. 1, providing a hinge connection between the panel 27 and the remainder of the end wall 26. Such hinge connections also are known in the art, and form no part of the present invention.

Figure 3:
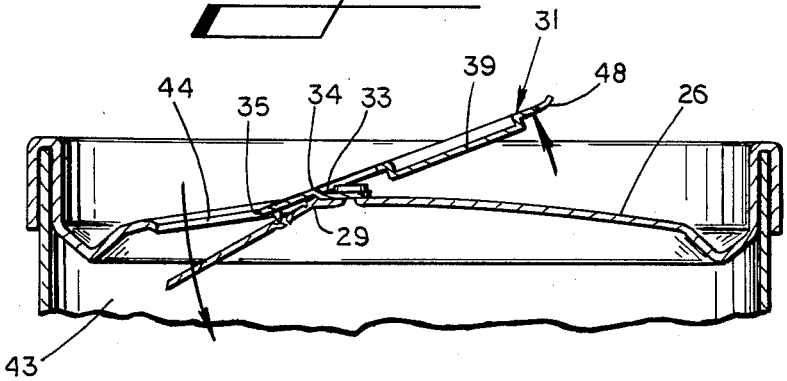
FIG. 3 is a section view as in FIG. 2, showing the opening tab partly raised and the separable panel partly displaced from the container end wall, and also showing the fractured pressure release member disposed inside the outer weakened region defining the operable panel.

An opening tab 31 is attached to the end wall 26 by means of a rivet 32 integrally formed in the end wall and extending upwardly through an opening in the tab portion 33 (FIG. 3). The rivet connection with the tab portion 33 secures the tab 31 to the end wall 26, but is sufficiently loose to allow pivoting movement of the tab in a plane parallel to the end wall.

The forward end 34 of the tab portion 33 joins the finger portion 35 of the tab 31. The finger portion 35 overlies a portion of the separable region 28 immediately to one side of the hinge connection 29, and a downwardly-facing spike 36 is formed on the underside of the finger portion. When the tab 31 is in the position shown in FIGS. 1 and 2, the spike 36 is immediately above a weakened region of the end wall 26. This weakened region can be on the separable region 28 passing beneath the finger portion 35 of the tab, or alternatively may be a separate well 37 (FIG. 2) formed in the panel 27 during the stamping operation which forms the end wall.

The tab 31 further includes a handle portion 38 disposed across the rivet 32 from the finger portion 35. The handle portion 38 has an integral reclosure 39 formed in the present embodiment by a dished region stamped in the handle portion and extending a short distance below the surrounding edge 40. The overall shape of the reclosure 39 should substantially conform with the shape of the panel 27, inasmuch as the reclosure is intended to fit snugly within the opening formed in the end wall 26 when the panel is separated and displaced from the end wall. The downward extent of the reclosure 39 causes the surrounding edge 40 to be spaced upwardly a short distance from the outer surface of the end wall 26, thereby facilitating grasping and manipulating the edge 40 by a person desiring to open the container. The upturned end 48 of the handle portion 38 aids manipulating the tab.

Turning now to the operation of the embodiment described, it is assumed the container 25 encloses a carbonate beverage so that the end wall 26 is under significant fluid pressure. This fluid pressure acting on the relatively thin and flexible end wall 26 substantially limits the flexibility of the end wall; because fracture of the separable region 28 is initiated by flexing the end wall in the vicinity of the separable region, this pressure preferably is released as the first phase of the opening process. Pressure release is accomplished by manually pressing down the tab finger portion 35 to force the spike 36 into the well 37, rupturing the relatively weakened bottom of the well and releasing fluid pressure from the container 25.

The container may now be opened by manually lifting the tab handle edge 40 upwardly from the end wall 26, in a direction to swing the tab 31 along a plane substantially normal to the end wall, as shown in FIG. 3. The forward end of the tab portion 33 functions as a hinge, forcing the tab finger portion 35 downwardly into engagement with the underlying portion of the openable panel 27. This downward force by the finger portion 35, applied to the end wall 26 in the vicinity of the separable region 28, causes the separable region to fracture and separate in a manner known to those skilled in the art. Continued swinging movement imparted to the tab handle 38 forces the now-opened panel 27 downwardly about its hinge connection 29, so that the panel moves below the end wall 29 in the interior 43 of the container 25. Once the container is fully opened in this manner, the tab 31 preferably is manually returned to its initial position shown in FIG. 2, with the tab substantially parallel to the end wall 26. The contents of the container may now be poured or consumed directly through the opening 44 remaining in the end wall 26.

Figure 4:
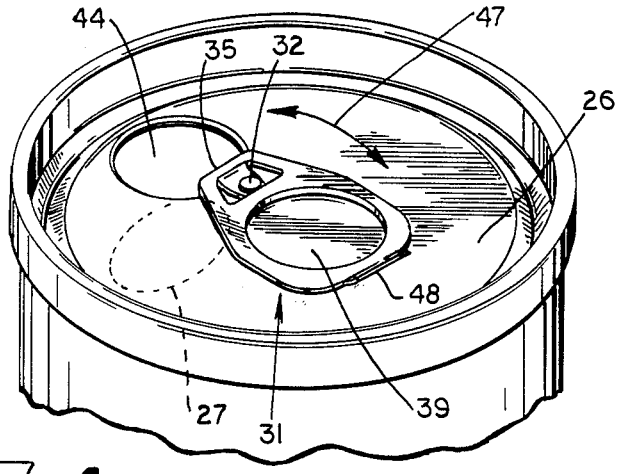
FIG. 4 is a pictorial view as in FIG. 1, showing the opened container.
Figure 5:
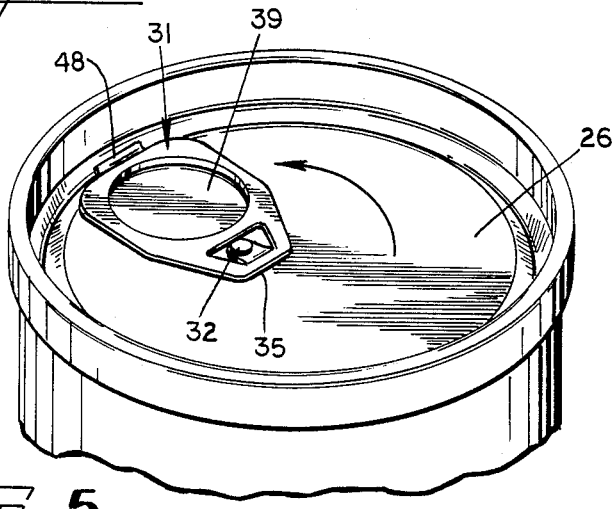
FIG. 5 is a pictorial view as in FIG. 4, showing the tab pivoted over the opening with the container reclosed.
Figure 6:
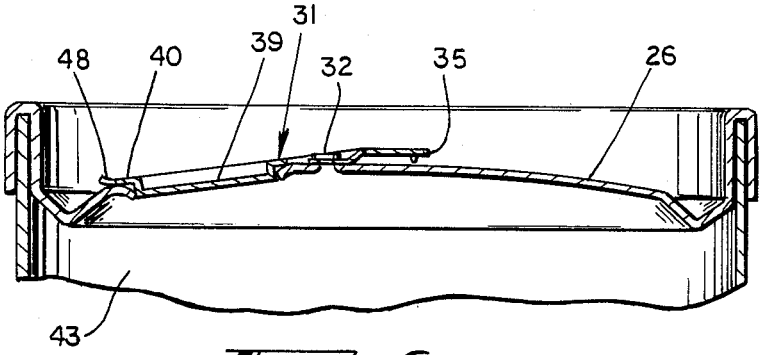
FIG. 6 is a vertical section view of the reclosed container shown in FIG. 5.

Reclosure of the opened container 25 is illustrated in FIGS. 4–6. When reclosure is desired, the tab 31 is pivoted in a plane substantially parallel to the end wall 26 approximately one-half turn about the rivet 32 as illustrated by the arrow 47, placing the handle portion 38 over the opening 44 in the end wall 26. This repositioning of the tab 31 is illustrated in FIGS. 5 and 6, and it can be seen that the reclosure 39 now is in registry with the opening 44 at this time. Simply pressing downwardly on the repositioned handle portion 38 depresses the reclosure 39 in the opening 44, seating the reclosure in the opening and thus blocking that opening against unwanted ingress or egress. The upturned end 48 formed at the outermost extremity at the edge 40 surrounding the reclosure provides a finger engagement for exerting upward force on the tab 31, thus dislodging the reclosure 39 from the opening 44 in the end wall. The tab 31 then can be pivoted about the rivet 32 to expose the opening 44.

Figure 7:
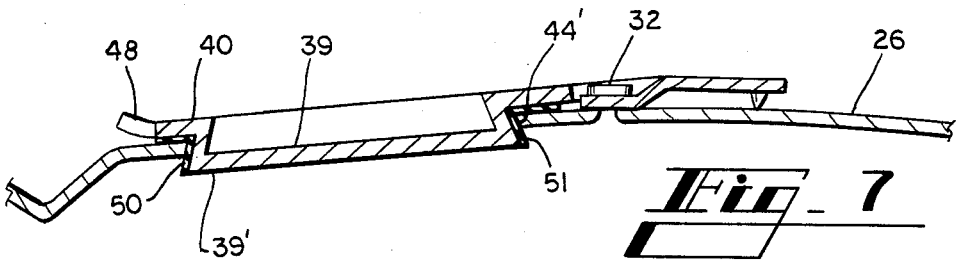
FIGS. 7 and 8 are fragmentary section views respectively showing two different embodiments of sealing technique usable with the present invention.
Figure 8:
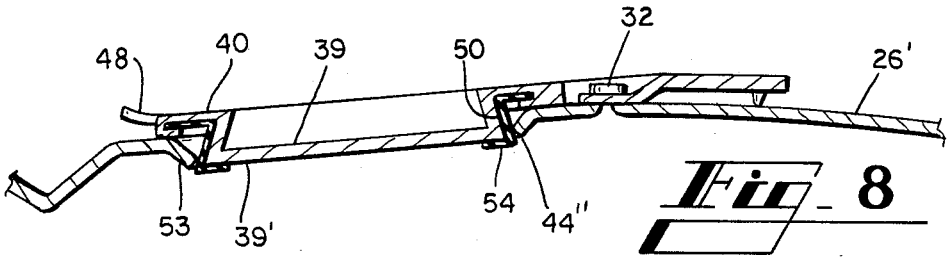

FIGS. 7 and 8 show details of the reclosure and its engagement with end wall portions surrounding the end wall opening, and also shows two alternative techniques for providing an airtight seal with the reclosure. Alternatively, the reclosure structure can omit any airtight seal, and rely only on the structural obstruction of the opening to accomplish the desired reclosure. FIGS. 7 and 8 show that the base 39' of the reclosure is slightly broader than the corresponding dimension of the end wall opening blocked by the reclosure. The wall portion 50 of the tab, extending upwardly from the reclosure base 39' to the underside of the surrounding edge 40 of the tab, thus is slightly angled to provide a snap-fit engagement with the surrounding periphery 44' of the opening in the end wall 26. This snap-fit engagement should be sufficient to prevent accidental or unwanted disengagement of the reclosure from the opening in the end wall, while permitting deliberate disengagement in response to manual force applied to the upturned end 48 of the tab.

To provide an airtight seal surrounding the reclosure in FIG. 7, a sealant coating 51 is applied to the wall portion 50 and to underside portions of the tab edge 40 immediately surrounding the periphery 44' of the opening in the end wall. This sealant coating may be a compound liner material sprayed or otherwise applied to the tab during manufacturing; the nature and composition of compound liner materials are known to those in the beverage container art. The sealant coating 51 on wall portions 50 surrounding the reclosure engage the periphery 44' of the opening and help maintain an airtight seal, thus preventing or reducing loss of carbonation from within the reclosed container.

FIG. 8 shows an end wall 26' of somewhat different configuration in the region surrounding the displaced openable panel (not shown for clarity). The end wall 26' is dished downwardly at 53 surrounding the opening shown blocked by the reclosure 39. The periphery 44'' of the opening in the end wall 26' thus engages the wall portion 50 adjacent the reclosure base 39'. A gasket insert 54, made of a suitable resilient sealing material such as cork, an elastomer, or the like is permanently fitted to the reclosure during manufacture and provides the same airtight sealing function as the sealant coating 51 shown in FIG. 7.

Figure 9:
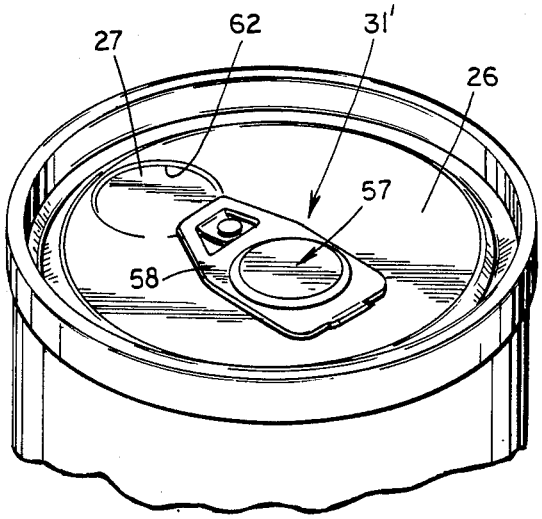
FIG. 9 is a fragmentary pictorial view showing an alternative embodiment of reclosure according to the present invention.
Figure 10A:
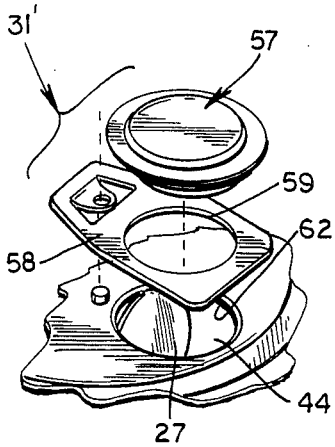
FIG. 10A is a fragmentary exploded view of the embodiment shown in FIG. 9, showing the separate reclosure insert.
Figure 10:
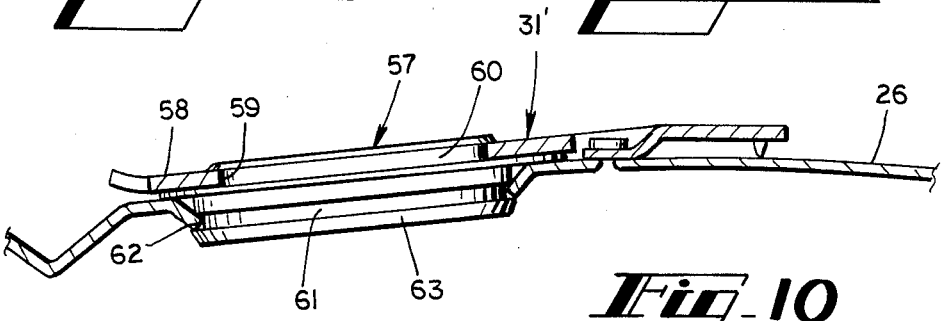
FIG. 10 is an enlarged fragmentary section view shwoing the embodiment of FIG. 9, with the container wall opened and reclosed.

The embodiment shown in FIGS. 9, 10 and 10A utilizes a tab 31' incorporating a separate reclosure insert in the form of the stopper element 57 in place of the integrally-formed reclosure 39, to reclose the opening 44 in the end wall 26. The handle portion 58 of the tab 31' has an opening 59 to receive the separate stopper 57, as best seen in FIG. 10A. The diameter and shape of the opening 59 in the tab handle 58 need not be the same as for the opening 44 formed in the end wall 26 by separation and displacement of the openable panel 27.

The stopper 57, as best seen in FIGS. 10 and 10A, includes an upper peripheral groove 60 configured to fit within the opening 59 in the tab handle 58, thereby nonremovably retaining the stopper as part of the overall tab 31'. The stopper 57 has a lower peripheral groove 61 located a short distance below the underside of the tab handle 58, and configured to snap-fit within the opening 44 formed in the end wall 26 when the openable panel 27 is separated and displaced away from the end wall, as illustrated in FIG. 10. The panel 27 is omitted from FIG. 10 for clarity. The diameter and shape of the groove 61 preferably conforms to the periphery 62 of the opening 44 in the end wall, and the lower edge of the groove 61 is formed by an annular flange 63 which engages the periphery 62 and forms a fluid tight seal therewith. The stopper 57 preferably is fabricated from an elastomeric material which is sufficiently resilient to provide snap-in engagement and snap-out removal of the stopper-tab assembly, and which does not adversely affect the contents of the container. The stopper 57 is attached to the tab 31' during manufacture, and remains attached to the tab during reclosure and reopening operations. It should be understood that the tab 31' otherwise functions in the same manner as the tab 31 previously described above.

FIGS. 11A–11D disclose another embodiment somewhat different from the apparatus previously described. Formed in the end wall 67 is an openable panel 68 entirely defined by an uninterrupted selectably separable region 69 formed by stamping or the like in a manner known to the art. An integral rivet 70 formed in the panel 68 secures the panel to one end 71 of the tab 72. The other end 73 of the tab 72 includes an integrally-formed reclosure 74 extending downwardly below a surrounding handle portion 75. As will be understood, the overall size and shape of the reclosure 74 is configured to provide a snap-in engagement with the opening remaining in the end wall 67 when the openable panel 68 is separated and displaced from the end wall.

The tab 72 is pivotably attached to the end wall 67 by the rivet 78 formed integrally with the end wall near its center. The rivet 78 extends through a mating opening in a tongue 80 in the central region 79 of the tab 72. The connection of the tongue with the rivet 78 allows the tongue and the remainder of the tab 72 to pivotably rotate above the rivet, in a plane parallel to the end wall 67. The rivet 78 connects to the tongue 80 at a location depressed somewhat below the central region 79 of the tab, as best seen in FIG. 11B, so that the tab may be rotated without interfering contact with the end wall 67.

A spike 83 extends downwardly from the underside of tab end 71, and the spike is disposed above a weakened region formed in the well 84 within the openable panel 68. When finger pressure is applied to the openable panel 68 by pressing downwardly on the tab end 71 as illustrated in FIG. 11C, the spike 83 initially penetrates the weakened region in the well 84, releasing pressure within the container. The end wall 67 thus is permitted to flex in response to the finger pressure, so that the separable region 69 can fracture in the conventional manner. The openable panel 68 thus is entirely separated from the remainder of the end wall 67 at this time. The opening thus formed in the end wall is now exposed by lifting upwardly on the end 71 of the tab to elevate the separated panel 68 above the outer surface of the end wall 67, and then rotating the entire tab 72 approximately 90° from the initial position shown in FIG. 11A to the phantom position shown in FIG. 11D. The contents of the can may now be dispensed from the opening in the end wall.

Figure 11A:
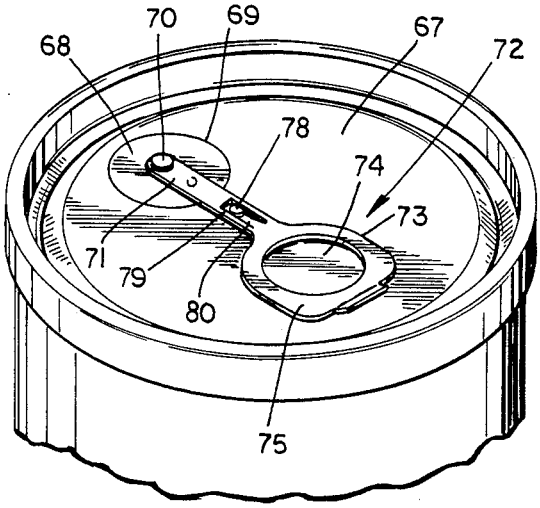
FIGS. 11A–11E are several views of another disclosed embodiment wherein the opening panel becomes completely separated from the end wall and moves across the end wall as the reclosure is moved in registry with the opening.
Figure 11B:
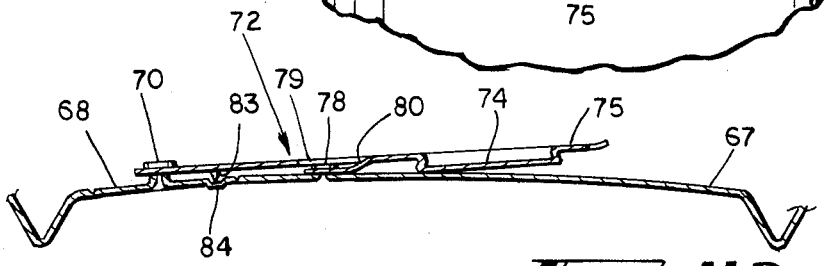
Figure 11C:
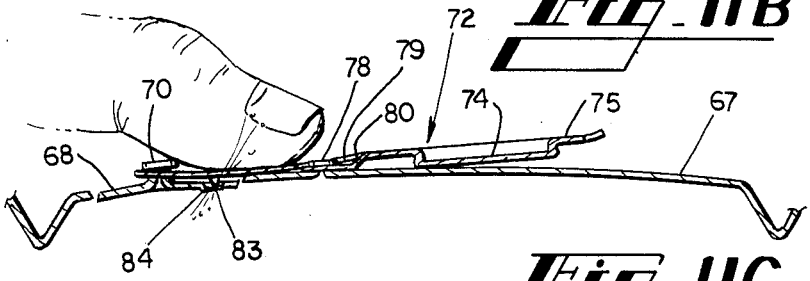
Figure 11D:
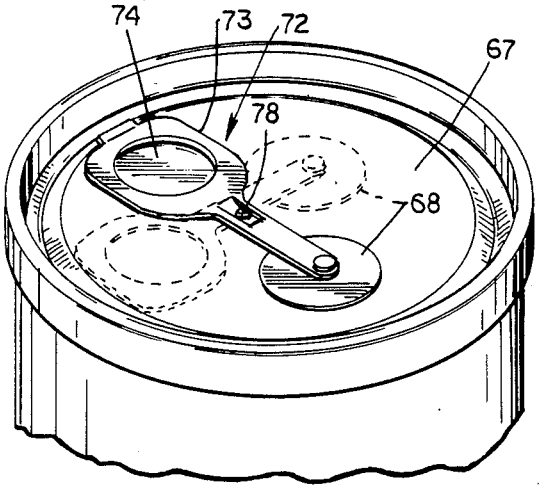
Figure 11E:
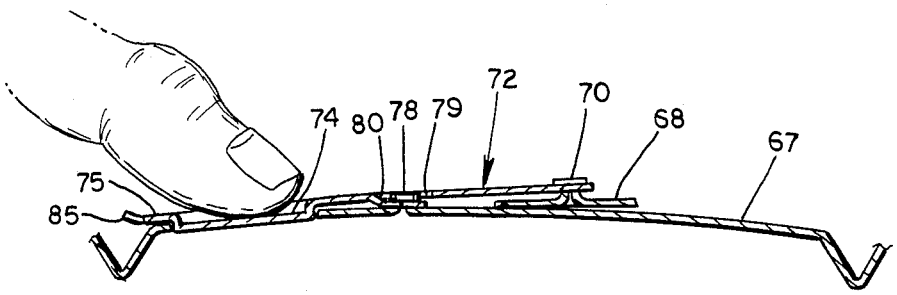

To reclose the can, the tab 72 is rotated to the position shown in solid line in FIG. 11D, 180° from the initial position in FIG. 11A. The end 73 of the tab thus is positioned over the opening in the end wall, and the reclosure 74 may now be engaged into that opening simply by pressing downwardly on the tab end 73 as illustrated in FIG. 11E. The reclosure 73 preferably is configured to provide a snap fit within the end wall opening. The separated openable panel 68 is retained on top of the end wall 67 at this time, approximately 180° displaced from the reclosed opening. The reclosure 75, as well as other reclosure structure according to the present invention, may include sealant as exemplified in FIGS. 7 and 8, although now shown in FIGS. 11A–11E. The reclosed container can be reopened by exerting finger pressure upwardly on the upturned end 85 of the tab 72.

Figure 12A:
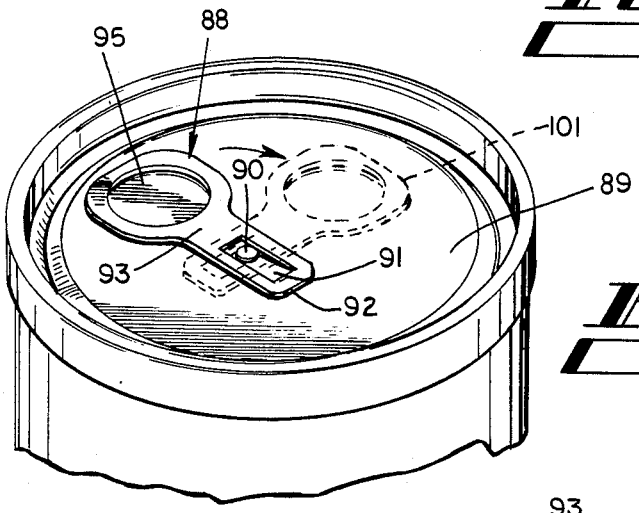
FIGS. 12A–12D are several views of a modification of the preceding embodiment.
Figure 12B:
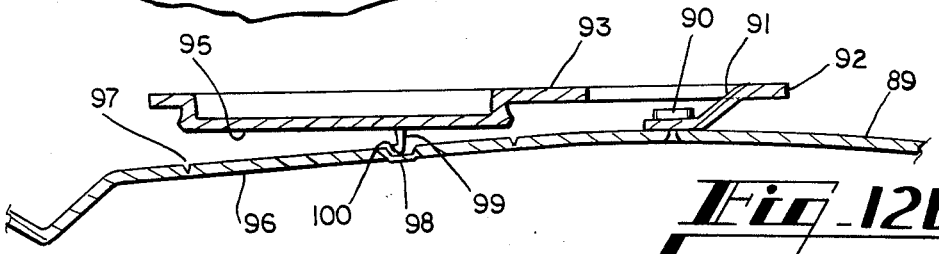
Figure 12C:
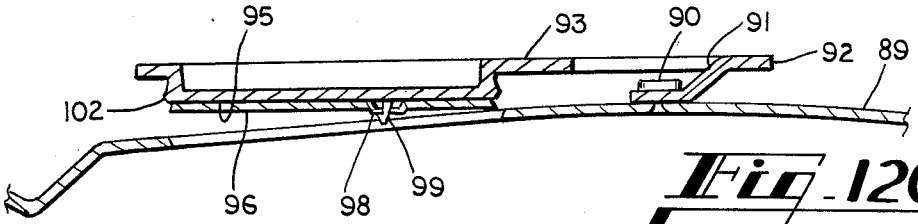
Figure 12D:
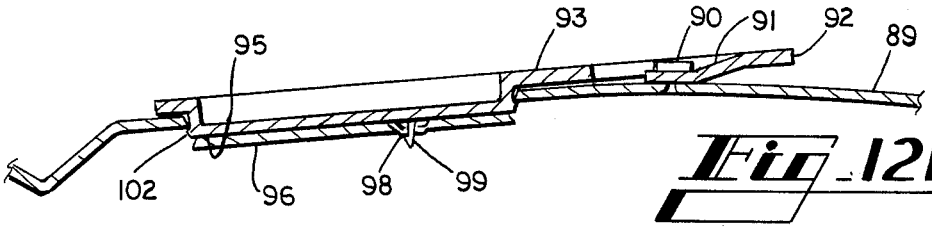

The embodiment shown in FIGS. 12A–12D has an opening tab incorporating reclosure structure overlying and attached to the openable panel defined in the end wall. Turning first to FIGS. 12A and 12B, an opening tab 88 is shown pivotably connected to a container end wall 89 by the rivet 90 formed in the end wall and extending through the tongue 91 extending forwardly from the inner end 92 of the tab. The rivet 90 preferably engages the tongue 91 at a point where the tongue preferably is depressed below the midportion 93 of the tab 88, as best seen in FIG. 12B, to facilitate pivoting movement of the tab on the end wall 89.

The tab 88 includes a reclosure portion 95 formed at the end of the midportion 93 remote from the inner end 92 and rivet 90. This reclosure portion 95 overlies the openable panel 96 formed in the end wall 89 by the continuous separable region 97, so that the panel 96 becomes completely separated from the remainder of the end wall 89 when the separable region is fractured. A well 98 of selectably weakened construction is formed in the panel 96 beneath the tab 88, and a hooked spike 99 is formed on the tab immediately above the wall in the panel. The hooked spike 99, best seen in FIG. 12C, has a pointed lower portion for fracturing the weakened region in the well 98, and also has a panel-engaging hook 100 which passes through the fractured well and thus retains the panel 96.

The embodiment shown in FIGS. 12A–12D works in the following manner. When finger pressure is applied downwardly to the tab 88, the hook spike 99 fractures the well 98 and the hook 100 passes through and engages the panel 96. The pressure in the container thus is released, so that finger pressure on the tab 88 may now fracture the separable region 97 to separate the panel from the remainder of the end wall 89. Because the hook 100 previously entered and engaged the panel 96, the tab 88 may now be lifted slightly (FIG. 12C) to raise the separated panel 88 above the end wall 89. The tab 88 with separated panel 88 thus attached may be rotated approximately 90° to the position shown in phantom at 101 in FIG. 12A, thereby exposing the opening in the end wall for pouring or drinking the contents of the container.

The reclose the opening in the end wall 89, the tab 88 is returned to its original position shown in solid line in FIG. 12A, placing the reclosure 95 above the opened end wall. By manually pressing down on the tab 88, the reclosure 95 enters and recloses the opening. The separated panel 96 remains engaged by the hook 100 at this time, as seen in FIG. 12B. The outer periphery 102 of the reclosure 95 may be slightly larger than the opening in the end wall, providing a snap-fit reclosure. The reclosed container may now be reopened as desired, in the manner previously described.

The embodiment shown in FIGS. 13A–13E utilizes a tab 105 attached to the container end wall 106 by an integral rivet 107 substantially offset from the center of the end wall. The tab 105 has a finger-engagable enlarged end 108 spaced apart from the rivet 107, and beneath the enlarged end is formed the reclosure 109. This reclosure is similar in nature and function to the reclosure members described above, so as to provide a snap fit into the opening formed in the end wall 106 when the openable tab 110 becomes separated from the end wall by fracturing the selectably separable region 111. A hooked spike 114 is formed on the underside of the tab enlarged end 108, in registry with the mating weakened well formed in the openable panel 110, and this hooked spike is similar in shape and function to the spike 99 in the preceding embodiment.

Figure 13A:
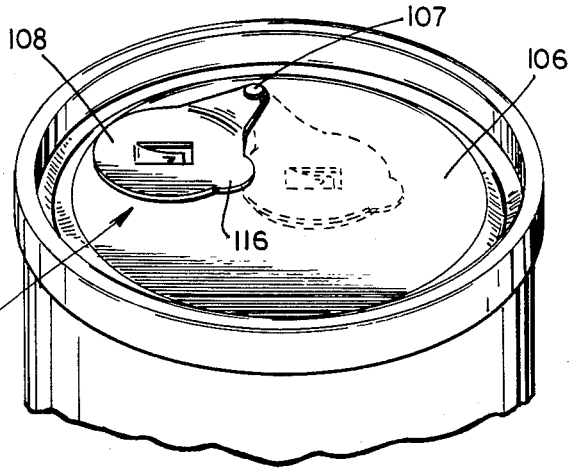
FIGS. 13A–13E are several views showing still another embodiment in which the separated panel is raised above the end wall during opening.
Figure 13B:
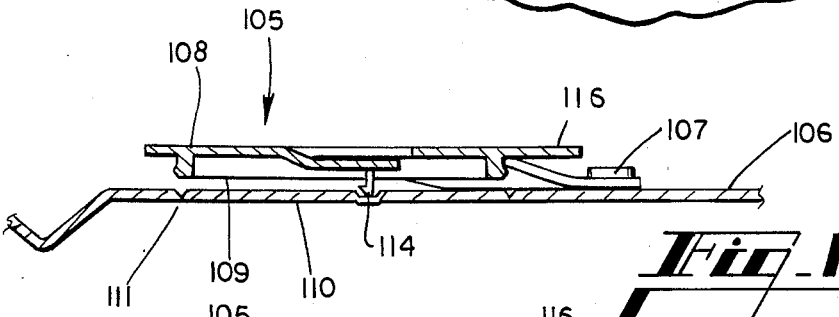
Figure 13C:
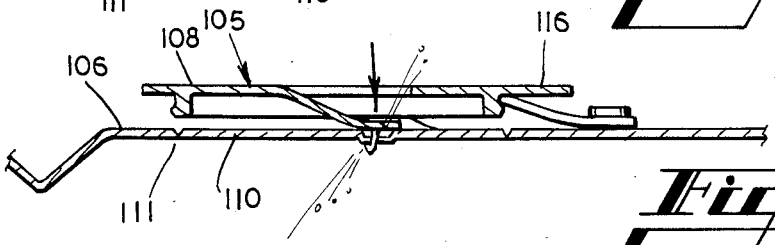
Figure 13D:
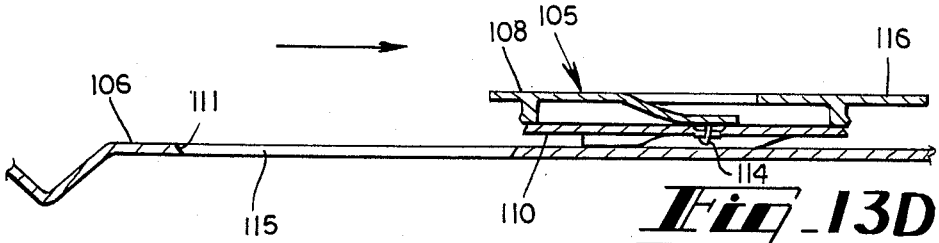

To open the embodiment shown in FIGS. 13A–13E, the tab 105 initially is pivoted about the rivet 107 to align the enlarged tab end 108 over the openable panel 110. Finger pressure then is applied downwardly against the enlarged end 108 as shown in FIG. 13C, causing the hooked spike to penetrate the panel and release the pressure within the container. The hooked spike 114 also engages the panel 110 at this time, preventing subsequent separation of the panel from the tab 105. With pressure released from the container, the downward manual pressure applied to the enlarged end 108 fractures the separable region 111, completely separating the panel 110 from the remainder of the end wall 106. The opening procedure is completed by raising the tab end 108 slightly to bring the separated panel 110 above the top of the end wall 106, and then pivoting the tab 105 to displace the tab end 108 and the attached panel 110 away from the opening 115 formed in the end wall, as shown in FIG. 13D.

Figure 13E:
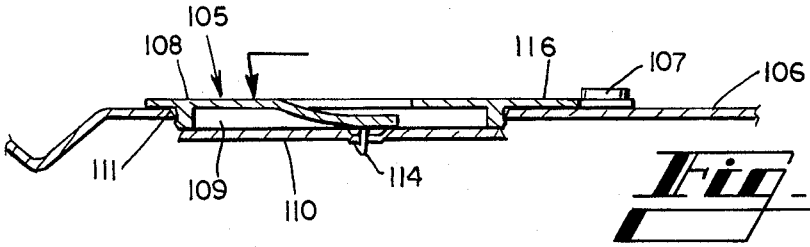

To reclose the opening 115, the tab 105 is pivoted to return the enlarged end 108 into registry with the opening as shown in FIG. 13E. Downward force on the tab end 108 snaps the reclosure 109 into the opening in the end wall, reclosing the container. The tab 105 preferably includes a release tab 116, FIG. 13A, formed on the enlarged end 108 to facilitate reopening the reclosed container by lifting upwardly on the release tab.

The use of a panel-engaging hook combined with the pressure release spike, as illustrated in several embodiments disclosed herein, has the advantage of eliminating the rivet attaching the panel to the opening tab, such as the rivet 70 in FIG. 11A. Replacing this rivet with a hooked spike thus eliminates several manufacturing steps required to form and attach the rivet to the tab, and permits easier lift-out and pivoting of the tab when opened. It should be understood that the disclosed alternatives of a rivet or hooked spike to secure the opened panel to the opening tab are not mutually exclusive, and both the rivet and hooked spike may be incorporated in a single embodiment. Moreover, both the rivet and hooked spike may be omitted, with the result that the opened panel enters the container and drops to the bottom when separated from the end wall. This latter alternative may be undesirable in certain applications, especially where beverages are consumed directly from the can, because of the real or imagined risk that the loose panel will come out of the can and be swallowed.

Figure 1:
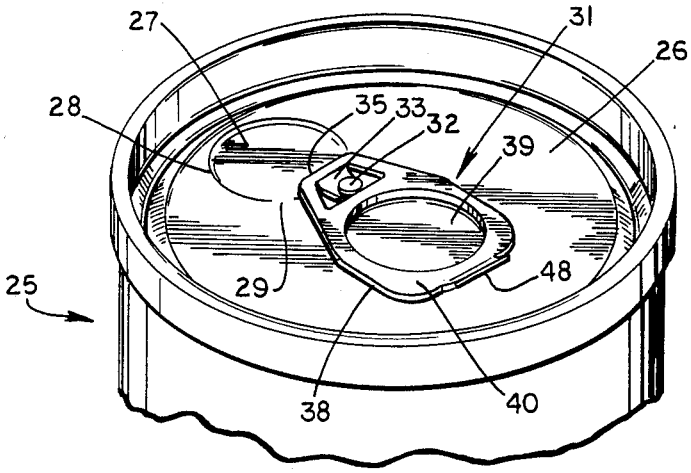
FIG. 1 is a fragmentary pictorial view of a beverage container equipped with a reclosable easy-opening end according to a first disclosed embodiment of the present invention.
Figure 2:
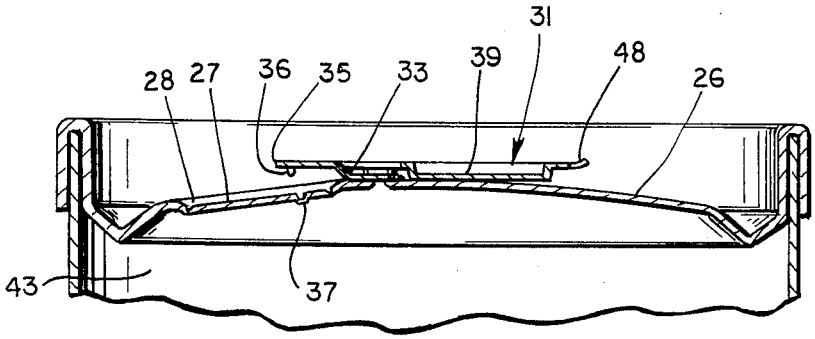
FIG. 2 is a vertical section view of the embodiment shown in FIG. 1.
Figure 14:
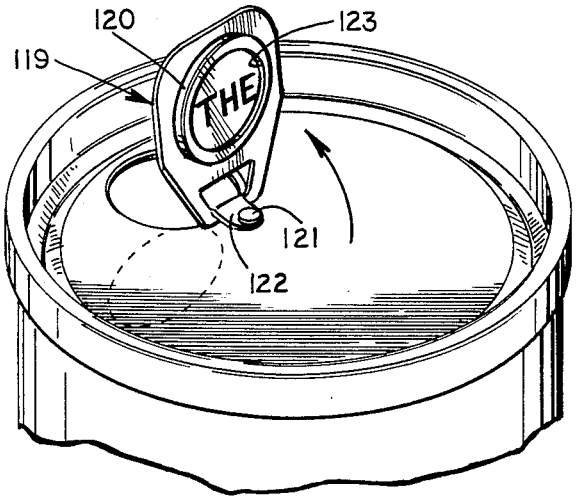
FIGS. 14 is a fragmentary pictorial view of a modified embodiment with a premium message on the underside of the tab and visible only when the tab is lifted and the container opened.

FIG. 14 shows a tab 119 equipped with a reclosure 120 beneath the handle portion of the tab, but modified to provide a region for concealing a premium message. The tab 119 is generally of the kind illustrated in FIGS. 1–6, where the tab is pivoted about a rivet 121 into reclosure position after swinging about the hinge connection 122 for opening the end; FIG. 14 depicts the tab 119 swung approximately 90° to an upright position, in the process of opening the container. The underside of the reclosure 120 preferably has a recessed interior region 123 to receive any desired premium message, illustrated in FIG. 14 by the word "THE". This premium message normally is concealed from view before the container is opened, because the underside of the reclosure 120 is held against the end panel as illustrated in FIG. 2. Printing the premium message in the recessed region 123 of the reclosure makes the premium message even more difficult to see without lifting the tab 119 sufficiently to break the separable region and separate the openable panel.

Figure 15A:
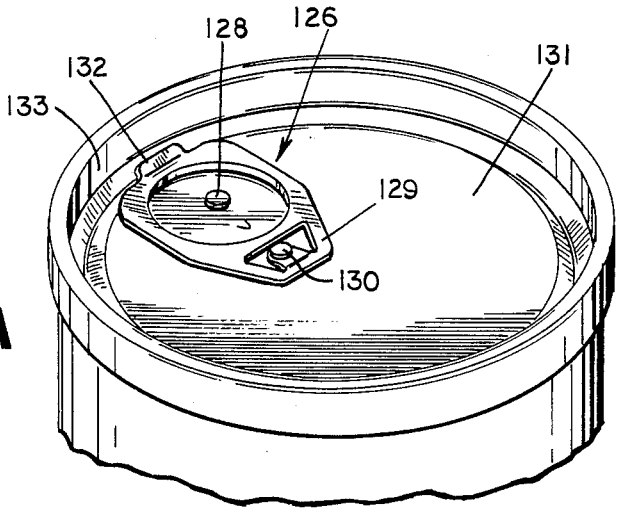
FIGS. 15A and 15B show another embodiment of the present invention, with the opening tab secured over the openable panel formed in the end wall, and shown in FIG. 15B opened and pivoted to reclose the opening.
Figure 15B:
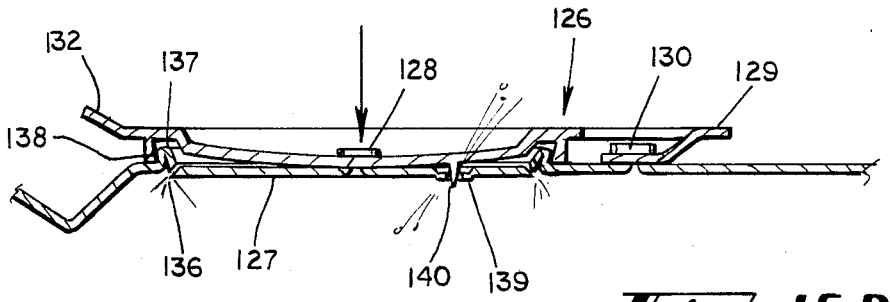

FIGS. 15A and 15B show an alternative embodiment having a one-piece opening tab and reclosure 126, with the tab secured to the opening panel 127 by a rivet 128 integral with the panel. One end 129 of the tab 126 is pivotably attached to the end wall 131 by an integral rivet 130 formed in the end wall. A finger-engaging flange 132 is formed at the other end of the tab 126, adjacent the chime 133 of the can.

The openable panel 127 formed in the end wall 131 is surrounded by a raised rim 136, FIG. 15B, and at least a portion of the rim is flanged as at 137 to form a reclosure catch engagable by the mating flange 138 located at least at the outer end of the tab 126 below the finger flange 132.

Before the can shown in FIGS. 15A and 15B is initially opened, the tab 126 is nonmovably secured to the end wall 131 by the rivets 128 and 130. To open the can, one first presses downwardly on the center area of the tab to pierce the weakened panel region 139 by the spike 140 formed on the underside of the tab. With container pressure thus released, continued downward force on the tab fractures the separable region and completely separates the panel 127 from the rest of the end wall 131. The tab 126 may now be lifted by the finger flange 132 to raise the separated panel 127 above the outer surface of the end wall, after which the tab with attached panel is pivoted about the rivet 130 to expose the pour opening.

To reclose the can, the tab is pivotably returned to a position in registry with the opening in the end wall. The tab is then pressed down against the end wall, snap-engaging the tab flange 138 with the flange 137 on the rim 136 surrounding the opening. The container is now reclosed, until again reopened by applying upward manual force to the finger flange 132. A compound lining material may be applied to bottom portions of the tab engaging the rim 136 during reclosure, to facilitate the sealing effect of reclosure.

Turning to FIGS. 16A–16C, the tab 146 is attached to the openable panel 147 by an integral rivet 148 formed in the panel and extending upwardly to engage the finger 149 formed with the tab. The tab finger 149 extends radially inwardly from the rim 150 of the finger-engaging region 151 of the tab, and the finger may be stamped or otherwise formed integrally with the tab. An arm 152 extends upwardly from the finger-engaging region 151, terminating at a pivotable connection with the end wall 153 by the integral rivet 154. The panel 147 formed in the end wall 53 is surrounded by a raised rim 157, FIGS. 16B and 16C, similar to the flange 137 shown in FIG. 15B.

The entire top and side surfaces of the flange 146 is enclosed by a reclosure cover 158, which may be of a resilient material such as rubber, plastic or the like. The sides of reclosure cover 158 extend downwardly over the rim 150 of the tab finger-engaging region 151, and have a flanged inner periphery 159 displaced slightly below the rim.

In using the embodiment shown in FIGS. 16A–16C, finger pressure is applied downwardly to the region 151 of the tab through the reclosure cover 158 to fracture the separable region in the end wall 153 defining the panel 147. A pressure-breaking spike (not shown) may be utilized if necessary. The panel 147, when separated from the end wall, is retained on the tab by the finger 149 but the panel moves inwardly a distance below the inside 153' of the end wall 153 as shown in FIG. 16C. The tab 146 may now be manually pivoted about the rivet 154, sliding the separated panel 147 beneath the inside 153' to the opened position shown in phantom in FIG. 16C. The opening remaining in the end wall 153 now is exposed.

To reclose, the tab 146 is pivoted back to the position shown in solid line in FIG. 16C and then pressed downwardly to engage the inardly-facing flange 159 of the reclosure cover 158 with the rim 157 surrounding the opening. The opening thus is reclosed, subject to being reopened simply by lifting upwardly on the reclosure cover 158 and attached tab 146.

Turning to the embodiment shown in FIG. 17A and 17B, a raised outwardly-protruding flange 163 surrounding the openable panel 164 and the facing flange 165 on the underside of the tab 166 are similar to the rim 157 and flange 159 of the preceding embodiment. However, unlike the embodiment shown in FIG. 16A, the tab 166 is attached only to the panel 164 and is not separately attached to the container end wall 167.

The upper surface 169 of the tab 166 is larger overall than the opening formed in the end wall 167 by separation of the panel 164, so that the tab cannot enter the container through that opening. The upper surface 169 also receives finger pressure directed downwardly against the end wall to open the container. A finger 170 extends downwardly from the forward edge of the tab 166 to contact the top of the panel 164, and the finger is secured to the panel by an integral rivet 171 formed in the panel.

The peripheral edge 172 of the separated panel 164, as best seen in FIG. 17B, has an inwardly-sloping bevel which prevents the separated panel from being withdrawn through the beveled edge 173 surrounding the opening formed in the end wall 167 by separation of the panel. This disclosed arrangement of confronting beveled edges on the separated panel and the remaining opening is produced by scoring techniques known in the art, and prevents the separated panel 164 and attached tab 173 from being withdraws from the container.

In the operation of the embodiment shown in FIGS. 17A and 17B, the panel 164 is separated in the conventional manner by pushing downwardly on the tab 166, fracturing the separable region defining the panel 164. When the panel 164 separates, the tab 166 moves slightly down to contact the top surface 174 on the flanged rim surrounding the opening in the end wall. The tab 166 may now be slidably displaced toward the center of the end wall to the position shown in phantom in FIG. 17A, exposing the opening in the end wall.

To enclose the opening, the tab 166 is slidably returned to the initial position shown in solid line in FIG. 17A. Downward pressure exerted on the tab causes the tab flange 165 to engage the fixed flange 163 surrounding the opening, retaining the tab in position reclosing the container. A clean cover 175 preferably is disposed over the entire tab 166 for sanitary purposes.

Figure 18A:
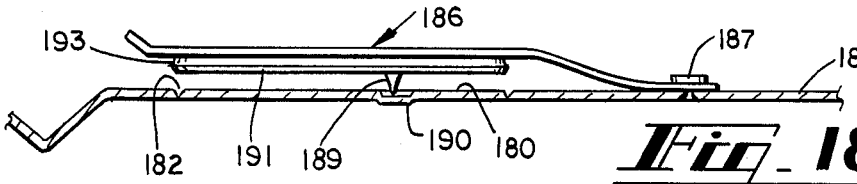
FIGS. 18A–18C are sectioned elevation views depicting another embodiment of the invention.
Figure 18B:
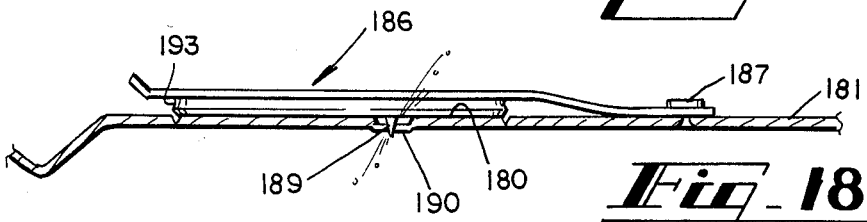
Figure 18C:
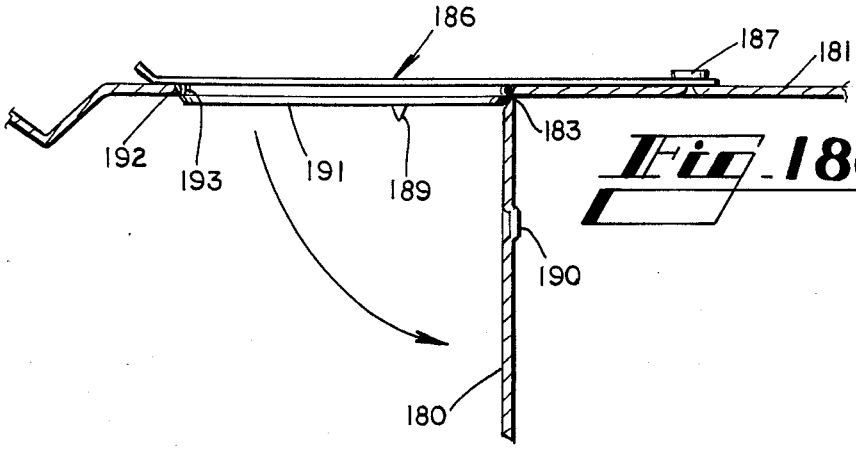

Turning next to FIGS. 18A–18C, the openable panel 180 is defined in the container end wall 181 by an interrupted separable region 182, leaving an unweakened region defining a hinge 183 (FIG. 18C) retaining the separated tab to the end wall. The separable panel 180 thus is similar to the panel 27 in FIG. 1.

A tab 186 is pivotably secured to the end wall 181 by the integral rivet 187. The tab 186 combines the structure and functions of an opening device to separate and displace thepanel 180, and a reclosure for the opened container. Finger pressure applied to the upper surface 188 of the tab, disposed above the panel 180, forces downwardly the spike 189 to fracture the weakened region 190 immediately below the spike. The spike 188 may be formed as an integral part of the tab 186. Pressure in the can is released by the spike, as illustrated in FIG. 18B, and continued downward pressure on the tab causes the separable region 182 to fracture. The tab 186 may now be pressed downwardly as illustrated in FIG. 18C, to swing the separated panel 180 around the hinge connection 183, opening the container and displacing the panel beneath the end wall 181. The tab 186 may now be lifted from the opening and pivoted around the rivet 187, exposing the container opening.

To reclose the container shown in FIGS. 18A–18C, the tab 186 is returned to position in registry with the opening. By pressing downwardly on the tab, the bottom 191 of the tab enters the opening in the end wall and the edge 192 of the opening snaps into the annular groove 193 surrounding the tab bottom, FIG. 18C. The container thus is reclosed, subject to being snapped open by lifting upwardly on the tab.

Figure 19A:
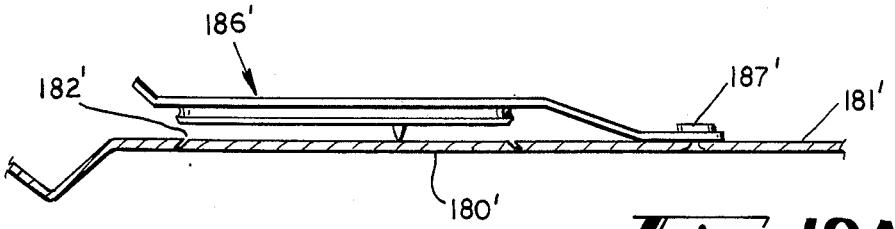
FIGS. 19A and 19C show an alternative embodiment of the present invention, in which the removable panel becomes completely separated from the can end.
Figure 19B:
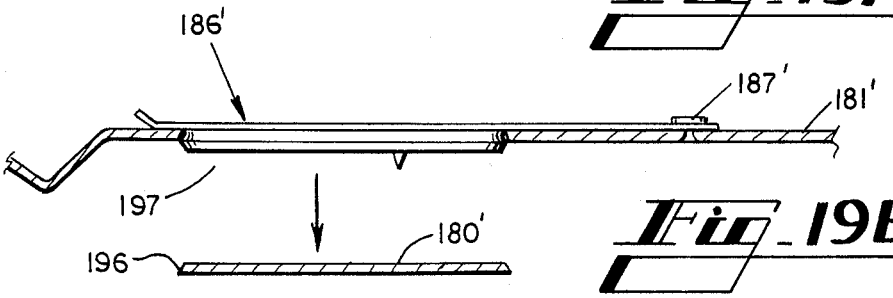

The embodiment shown in FIGS. 19A and 19B is similar to the immediately-preceding embodiment, except that the panel 180' is defined in the end wall 181' by an uninterrupted separable region 182'. Thus, when the separable region is fractured by initially releasing pressure in the can as shown in FIG. 19B and subsequently pressing downwardly on the tab to separate the panel 180', that panel completely separates from the end wall 181' and drops downwardly into the can as shown in FIG. 19B. The separable region 182' preferably is a score as described above with regard to FIGS. 16A–16C, providing confronting beveled edges 196 (FIG. 19B) which prevent the separated panel 180' from exiting the hole 197 in the can while pouring or consuming its contents.

Figure 20A:
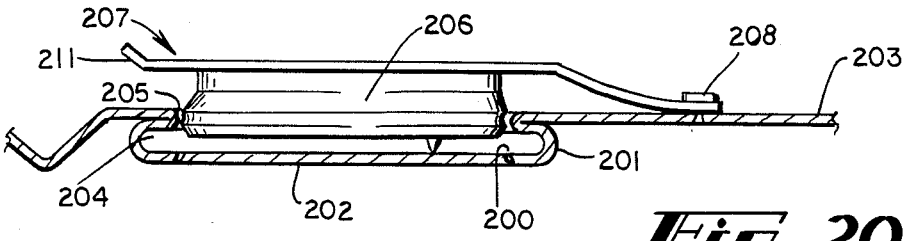
FIGS. 20A and 20B show a modification of the immediately preceding embodiment, wherein the openable panel is in a well recessed in the end wall.
Figure 20B:
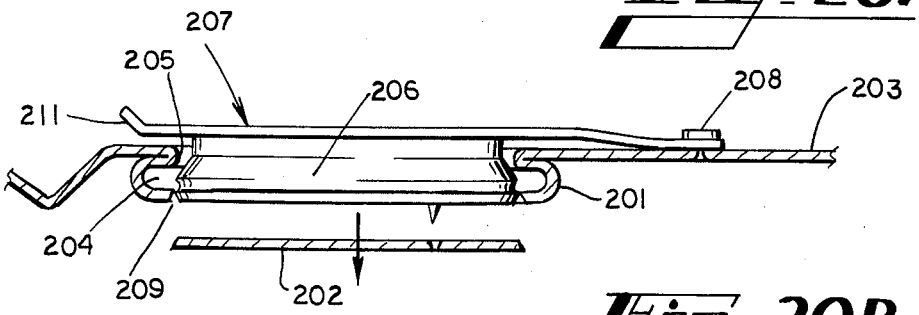

The embodiment shown in FIGS. 20A and 20B is similar to that of FIG. 19, except that the separable region 200 is formed at the bottom of a flanged depression 201, placing the separable panel 202 at the bottom of a well 204 slightly depressed below the end wall 203 of the container. The top edge 205 of the well 204 receives the panel-engaging bottom 206 of the tab 207, as shown in FIG. 20B, so that the panel can be separated from the end wall 203 by fracturing the separable region 200 in the manner previously described. The tab 207 then can be withdrawn from the well 204 and pivoted around the integral rivet 208, exposing the opening 209 for consumption.

Figure 20C:
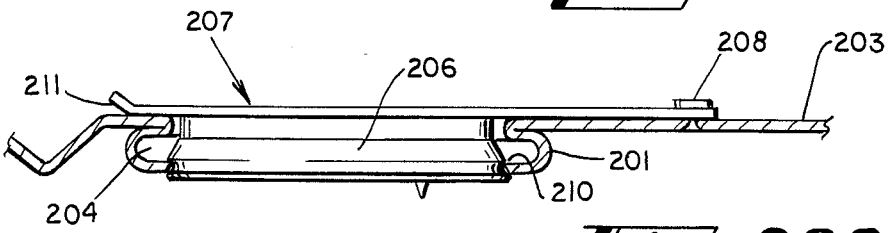

For enclosure, the tab 207 is returned to registry with the well 204, and is pressed downwardly into the well, as shown in FIG. 20C. The diameter of the opening 209 at the bottom of the well is slightly less than that of the flanged groove 210 surrounding the bottom 206 of the tab, thus providing a snap engagement of the tab within the well and reclosing the container. The reclosed container can be reopened by upward finger pressure on the release tab 211 at the front of the tab 207.

The embodiment in FIGS. 21A–21E features a tab slidably attached to the container end wall, and including an underside cam surface which progressively engages the openable panel to push the severed panel down and around a hinge. The tab 214, FIG. 21A, includes an enlarged central region 215 and a finger 216 extending from the central region toward the center of the container end wall 217. An integral rivet 218 extends upwardly from the end wall through the slot 219 in the tab finger 216, attaching the tab to the end wall for sliding movement on the path indicated by the arrow 220. The path of tab sliding movement may be guided by optional protrusions (not shown) formed in and extending outwardly from the end wall 217 on either side of the tab finger 216.

Figure 21A:
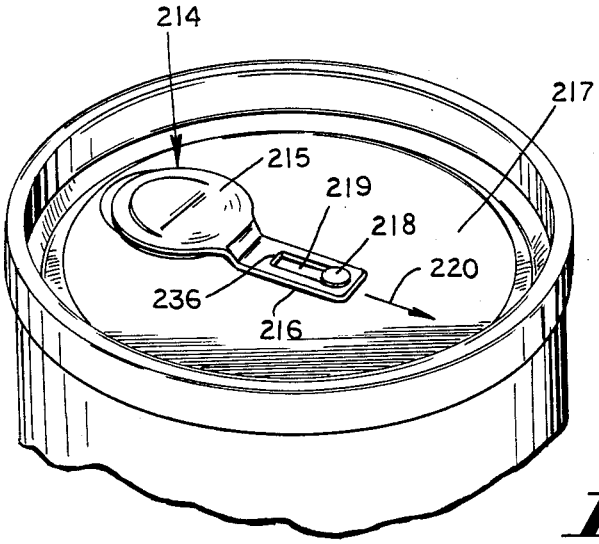
FIGS. 21A–21E show still another embodiment of the present invention, utilizing a slidable opening tab.
Figure 21B:
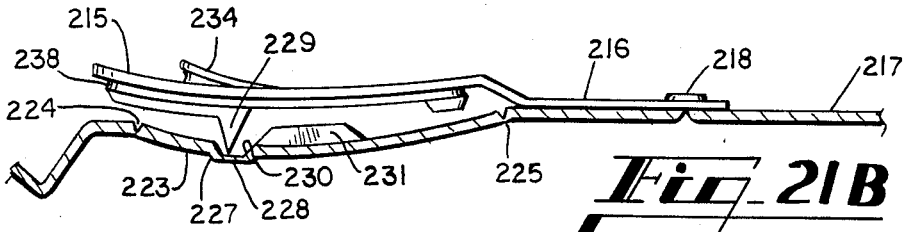
Figure 21C:
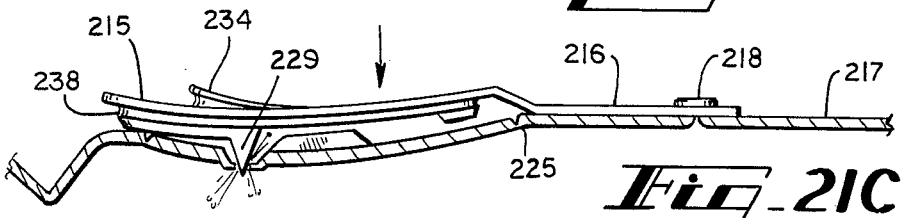
Figure 21D:
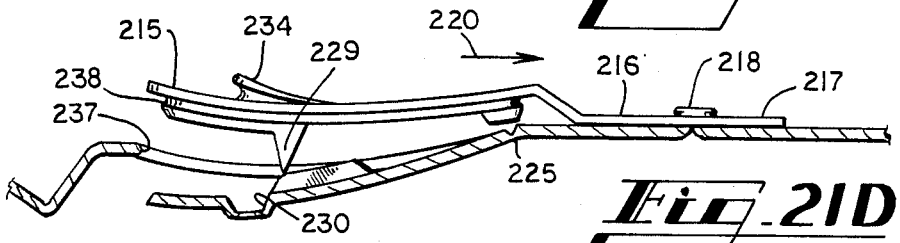

When the tab 214 is substantially extended outwardly along its slidable movement as shown in FIG. 21B, the central region 215 of the tab is in registry above the openable panel 223 defined in the end wall 217 by the separable region 224. This separable region 224 is discontinuous, leaving a nonseparating region defining a hinge 225 as becomes apparent below. The underside of the tab central region 215 includes a pressure release spike 227 which enters the well 228 formed in the panel 223. The spike 227 is at the lower end of an inclined ramp surface 229 extending up to the underside of the tab central region 215, and this ramp surface confronts a cam surface 230 at the back of the well 228 in the panel 223. The upper edge of the cam surface 230 meets a raised surface 231 formed in the panel 223, extending back toward the hinge 225 connecting the panel with the end wall 217.

The operation of the embodiment shown in FIGS. 21A–21E is now described. Opening is initiated by pressing downwardly on the upper surface 234 of the tab central region, driving the spike 227 into the well 228 to fracture the weakened region therein and release pressure from within the container, FIG. 21C. Further downward force on the tab 214 severs the separable region 224, so that the tab 223 remains attached to the end wall 217 only by the hinge connection 225. The tab 214 is now slidably moved toward the center of the container by finger pressure parallel to the container end wall 217 as shown by arrow 220, FIG. 21D. As the tab slides toward the center of the end wall, the ramp surface 229 on the tab engages the cam surface 230 on the panel 223, pushing the panel downwardly around the hinge 225. The spike 227 and ramp 229 progressively travel along the channel 230 and surface 231 in the panel 223, FIG. 21D, as the tab slides back, pushing the panel further down and open. Backward sliding movement of the tab 214 is arrested when the spike 229 contacts the back edge 234 of the opening 235, or when the front end 236 (FIG. 21A) of the slot 219 contacts the rivet 218. The container is now fully opened, and the contents of the can may be poured or consumed.

Figure 21E:
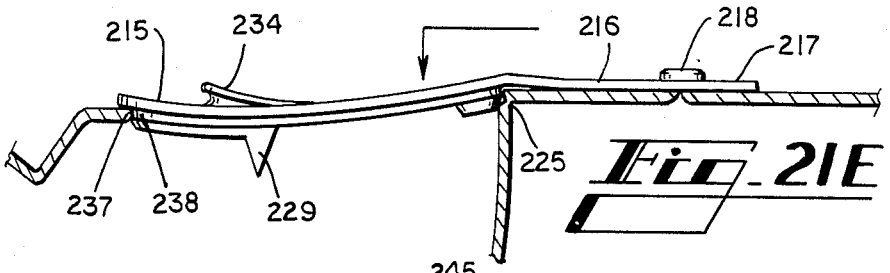

To reclose the container, the tab 214 is slid back to cover the opening 235, FIG. 21E. The tab 214 can now be pushed downwardly for snap engagement with the rim 237 of the container opening, retaining the tab in place reclosing the container. The container thereafter can be opened by lifting up on the tab to unsnap the reclosure, and then sliding the tab back along the slot 219.

Figure 22:
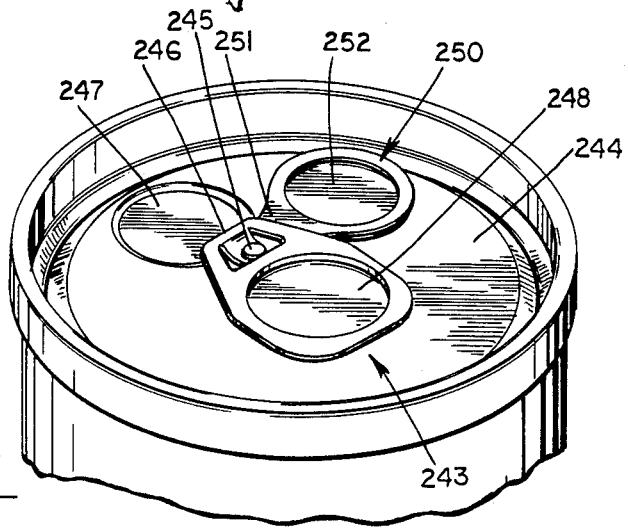
FIG. 22 is a fragmentary pictorial view of another disclosed embodiment, having a closure separate from the opening tab.

The embodiment shown in FIG. 22 utilizes an opening tab 253 pivotably attached to the end wall 244 by the rivet 245. The tab has a finger 246 overlying an openable panel 247 defined in the end wall 244, and a recessed region 248 may be formed in the tab; the tab 243 may be structurally and functionally similar to the tab 31 shown in FIGS. 1–6.

A separate closure member 250 is pivotably attached to the end wall 244 by the rivet 245 extending through the finger 251 extending from the closure member. The finger is sandwiched between the end wall 244 and the opening tab 243, so that the closure member 250 can pivot around the end wall. A reclosure 252 is formed in the closure member 250, and this reclosure is shaped and located for selectable registry with the opening remaining in the end wall 244 by separating the panel 247 from the end wall.

The operation of the embodiment shown in FIG. 22 should now be apparent. The container including the end wall 244 is opened by lifting the tab 243 to force the finger 246 against the panel 247, as described relative to FIGS. 1–6. The tab 243 is manually returned to the position shown in FIG. 21, when opening is completed. To reclose the opened container, the closure member 250 is pivoted approximately 90° from the position shown in FIG. 22 to position the reclosure 252 over the end wall opening formed by displacing the panel 247. The reclosure 252 is seated in the opening by pressing downwardly, and subsequently can be removed by lifting upwardly and pivoting away from the opening. The separate tab 243, during reclosure, remains in the position shown in FIG. 22.

It will thus be seen that a number of embodiments of the present invention have been disclosed and discussed in detail. It should be apparent that the foregoing description and disclosure relate only the present embodiments, and that numerous modifications and alterations may be made therein without departing from the spirit and scope of the invention as defined in the following claims.

I claim:

1. Selectably reclosable easy opening apparatus for a container, comprising:

a container wall;

a selectably openable panel defined in said wall at least in part by a selectably separable region of predetermined weakness formed in the container wall;

a unitary opening and reclosure member pivotably attached to said wall and having a hinge connection permitting selectable movement of said member on a first path substantially normal to the container wall; said pivotable attachment allowing the unitary opening member to undergo movement on a second path substantially parallel to the container wall;

said opening member having a finger portion overlying said openable panel in position to apply force downwardly against the openable panel in response to movement of the opening member about said hinge connection along said first path, thereby separating said separable region and displacing said panel downwardly relative to said wall, so that an opening is formed in said wall by separation and downward displacement of said panel;

said unitary opening member having reclosure plug means confronting the container wall at a location displaced from said openable panel while said finger portion overlies the openable panel; and said plug means being located on the opening member in relation to said pivotable attachment so as to be selectably registrable with said opening by pivoting said opening member on said second path after said opening is formed;

so that the container may be opened by hinging the opening member on said first path, and thereafter may be reclosed by pivoting the opening member on said second path and urging said plug means into removable engagement with the container wall adjacent said opening therein.

2. Apparatus as in claim 1, further comprising:

means defining a structurally weakened pressure venting region on said panel at a location within said region of predetermined weakness defining the panel; and a vent rupturing member disposed on the panel-confronting side of said finger portion and aligned with said pressure venting region to engage and rupture said weakened pressure venting region in response to initial movement of said opening member about the hinge connection before the finger portion contacts the openable panel and applies said separating force to said separable region, so that the pressure venting region is first opened to release fluid pressure from within the container before applying said force against the openable panel.

3. Apparatus as in claim 1, wherein:

said opening member has a manual grasping portion on the side of said hinge connection opposite from said finger portion; and said finger portion being located on said opening member to move downwardly to engage and exert force on said openable panel in response to movement of the opening member on said first path about said hinge connection by manually lifting said grasping portion upwardly from the container wall, thereby separating said separable region and displacing said panel downwardly from the remainder of said wall.

4. Apparatus as in claim 3, wherein:

said hinge connection comprises hinge means attached to said container by rivet means formed on said container wall and operative to define said second path of movement substantially parallel to said wall;

said rivet means pivotably connecting the opening member to the container wall so that said opening member can be pivoted about said rivet means to place said reclosure plug means in said registry with said opening formed in the container wall, for selective reclosure of said opening.

5. Apparatus as in claim 1, wherein:

said reclosure means is operable for selective engagement with said wall when registered with said opening, said engagement retaining the reclosure means in the opening.

6. Apparatus as in claim 5, further comprising:

sealing means associated with said reclosure means to effect a fluid-tight seal with the periphery of said opening when the reclosure means is engaged for retention in the opening.

7. Selectably reclosable easy opening apparatus for a container, comprising:

a container wall;

a selectably openable panel defined in said wall at least in part by a selectably separable region of predetermined weakness formed in the container wall;

an opening member attached to said wall by a rivet formed on the container wall, said rivet attachment allowing pivoting movement of the opening member on a path substantially parallel to the container wall;

said opening member having a first end portion which overlies part of the openable panel, having a second end portion in spaced apart relation to said first end portion, and having hinge means located between said first and second end portions and operative to move the first end portion inwardly to engage the underlying portion of the openable panel as said second end portion is moved outwardly away from the container wall, so as to separate the selectably separable region and displace the openable panel away from the container wall and thereby form an opening in the container wall;

a reclosure member located on said opening member in facing relation to the container wall and displaced from said openable panel while said first end portion of the opening member overlies the openable panel; and said reclosure member being disposed in predetermined relation to said rivet attachment so as to be aligned with said opening by pivoting said opening member on said path after said opening is formed;

so that the container may be opened by moving the first end portion into engagement with the openable panel, and thereafter may be reclosed by moving the opening member around the rivet to align the reclosure member with the opening;

the reclosure member there being operative to engage the end wall when pressed downwardly to reclose the opening, and being releasable to reopen the opening when lifted upwardly from the container wall.

8. Apparatus as in claim 7, further comprising:

means defining a structurally weakened pressure venting region on said openable panel at a location within said region of predetermined weakness defining the panel;

means associated with said first end portion of the opening member to engage and rupture said weakened pressure venting region before applying said separating force to said separable region as said second end portion of the opening member is moved away from the container wall, so that the pressure venting region initially is opened to release fluid pressure from within the container before before further movement of the first end portion separates and downwardly displaces the openable panel to form said opening in the container wall;

said opening member having a manual grasping portion on one side of said hinge means at said second end portion;

said first end portion comprises a finger portion operative to move downwardly to engage and exert force on said openable panel as the opening member is moved about said hinge connection by manually lifting said grasping portion upwardly from the container wall, thereby separating the separable region and displacing said panel downwardly from the remainder of said wall; and said reclosure member is on said one side of said hinge means, in position to move into registry with said opening by pivoting said opening member with respect to said rivet.

9. In a container having a aluminum top with a tab opening mechanism engaging a scored flap in said top for forming a contents dispensing aperture, the improvement comprising: a resealing means on said tab opening mechanism for hermetically resealing said aperture, wherein said tab mechanism includes a pivot element centrally connected to said aluminum top and a tab member having a finger lift portion and a detent edge, said tab member being pivotally connected to said pivot element between said finger left portion and said detent edge, said detent edge being directed at said scored flap for separating said flap from said aluminum top and depressing said flap into said container on lifting said lift portion and, wherein said resealing means comprises a stopper member incorporated on the underside of said lift portion of said tab member, said stopper member having a configuration complementary to said aperture formed on opening said container, said stopper member being inserted in said aperture by pivoting said tab member to locate said stopper member over said aperture and depressing said lift portion of said tab member.

10. The improved tab mechanism for aluminum top containers of claim 9, wherein said stopper member comprises a downwardly projecting sealing lip stamped into said lift position of said tab member, said sealing lip having an outer configuration conforming to said dispensing aperture.

11. The improved tab mechanism of claim 10, wherein said sealing lip includes an outer coated layer of deformable material for conforming to said dispensing aperture.

12. The improved tab mechanism of claim 9, wherein said stopper member comprises a projection element on the underside of said left portion of said tab, said projecting element being engageable with said dispensing aperture to seal said container.

13. The improved tab mechanism of claim 12, wherein said projecting element is deformable for conforming to said dispensing aperture.

14. The improved tab mechanism of claim 12, wherein said projecting element has a deformable surface for conforming to said dispensing aperture.

15. The improved tab mechanism of claim 9, wherein said left portion of said tab member has an upwardly angled edge adapted for engagement by a user's fingers.

* * * * *